US010480050B2

(12) United States Patent
Takebe et al.

(10) Patent No.: US 10,480,050 B2
(45) Date of Patent: Nov. 19, 2019

(54) TITANIUM SHEET AND METHOD FOR PRODUCING THE SAME

(71) Applicant: NIPPON STEEL & SUMITOMO METAL CORPORATION, Tokyo (JP)

(72) Inventors: Hidenori Takebe, Tokyo (JP); Yoshihisa Shirai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 128 days.

(21) Appl. No.: 15/553,635

(22) PCT Filed: Mar. 1, 2016

(86) PCT No.: PCT/JP2016/056313
§ 371 (c)(1),
(2) Date: Aug. 25, 2017

(87) PCT Pub. No.: WO2016/140231
PCT Pub. Date: Sep. 9, 2016

(65) Prior Publication Data

US 2018/0245185 A1 Aug. 30, 2018

(30) Foreign Application Priority Data

Mar. 2, 2015 (JP) ..... 2015-040550

(51) Int. Cl.

| | |
|---|---|
| ***C22C 14/00*** | (2006.01) |
| ***B21B 3/00*** | (2006.01) |
| ***C22F 1/18*** | (2006.01) |
| *C22F 1/00* | (2006.01) |
| *F28F 21/08* | (2006.01) |

(52) U.S. Cl.
CPC ..... *C22C 14/00* (2013.01); *B21B 3/00* (2013.01); *C22F 1/18* (2013.01); *C22F 1/183* (2013.01); *C22F 1/00* (2013.01); *F28F 21/086* (2013.01)

(58) Field of Classification Search
CPC ..... C22C 14/00; C22F 1/183
See application file for complete search history.

(56) References Cited

FOREIGN PATENT DOCUMENTS

| | | | | |
|---|---|---|---|---|
| CN | 102312126 | | 1/2012 | |
| CN | 102618752 | | 8/2012 | |
| CN | 103097559 | | 5/2013 | |
| CN | 103484805 | | 1/2014 | |
| CN | 103572094 | | 2/2014 | |
| EP | 0 992 599 | | 4/2000 | |
| EP | 0992599 | A1 * | 4/2000 | ..... C22C 14/00 |
| EP | 2 402 468 | | 1/2012 | |
| EP | 2 671 956 | | 12/2013 | |
| JP | 2004-183079 | | 7/2004 | |
| JP | 4061211 | | 3/2008 | |
| JP | 4088183 | | 5/2008 | |
| JP | 4094395 | | 6/2008 | |
| JP | 4157891 | | 10/2008 | |
| JP | 4157893 | | 10/2008 | |
| JP | 2010-031314 | | 2/2010 | |
| JP | 4486530 | | 6/2010 | |
| JP | 2010-202952 | | 9/2010 | |
| JP | 2010-236067 | | 10/2010 | |
| JP | 2012-057200 | | 3/2012 | |
| JP | 2012-158776 | | 8/2012 | |
| JP | 2014-012881 | | 1/2014 | |
| JP | 5435333 | | 3/2014 | |

* cited by examiner

*Primary Examiner* — Jessee R Roe
(74) *Attorney, Agent, or Firm* — Clark & Brody

(57) ABSTRACT

A titanium sheet has a chemical composition containing, in mass %, Cu: 0.1 to 1.0%, Ni: 0.01 to 0.20%, Fe: 0.01 to 0.10%, O: 0.01 to 0.10%, Cr: 0 to 0.20%, the balance: Ti and unavoidable impurities, and satisfying $0.04 \leq 0.3Cu + Ni \leq 0.44\%$. The average grain size of α phase is 15 μm or larger, and an intermetallic compound of Cu and/or Ni, and Ti is at 2.0 volume % or less. This titanium sheet has excellent workability and high strength.

4 Claims, 5 Drawing Sheets

TITANIUM SHEET AND METHOD FOR PRODUCING THE SAME

TECHNICAL FIELD

The present invention relates to a titanium sheet and a method for producing the titanium sheet.

BACKGROUND ART

Pure-titanium sheets are used as a starting material of various products such as heat exchangers, welded tubes, and a two-wheeled exhaust system including mufflers. In recent years, there is an increasing need to strengthen titanium sheets to reduce the wall thicknesses and the weight of these products. There is also a demand of keeping both high strength and the workability of pure-titanium sheets as before. Among others, pure titaniums that have excellent workability are used especially for a starting material of a plate-type heat exchanger (hereinafter, will be referred to as a "plate heat exchanger") because the starting material is to be press-molded into a complex shape.

To enhance a heat-exchanging efficiency required for a plate heat exchanger, the reduction of wall thickness is needed. Since the wall thickness reduction decreases workability and pressure resistance performance, it is necessary to secure sufficient workability and enhance strength. Thus, in order to obtain more excellent strength-workability balance than that of a normal pure titanium, studies are underway regarding the optimization of the content of O, the content of Fe, and the like, and grain size control.

For example, Patent Document 1 discloses a pure-titanium plate having an average grain size of 30 μm or larger. However, pure titaniums are inferior in strength.

Hence, Patent Document 2 discloses a titanium alloy plate that contains amounts of O and Fe as a β stabilizing element, and including α phase of the average grain size of which is 10 μm or smaller. Patent Document 3 discloses a titanium alloy sheet that contains decreased amounts of Fe and O, and contains Cu to cause $Ti_2Cu$ phase to precipitate, so as to suppress the growth of crystal grain sizes by the pinning effect, and that has an average grain size of 12 μm or smaller. Patent Document 4 discloses a titanium alloy that contains Cu, and has a decreased content of κ.

According to these documents, use is made of the fact that, when a titanium contains alloying elements in large quantities, crystal grains are made fine, and the titanium is likely to have high strength, and further, workability is secured by decreasing the content of O and the content of Fe. However, the techniques disclosed in these documents fail to show high strength while keeping sufficient workability to the extent that can meet the demands of recent years.

Meanwhile, in contrast to these documents, techniques to coarsen crystal grains while containing alloying elements are studied.

For example, Patent Document 5 discloses a titanium alloy used for a cathode electrode for producing electrolytic copper foil, the titanium alloy having a chemical composition that contains Cu and Ni, and being annealed at a temperature within a range of 600 to 850° C. to have a crystal grain size adjusted to 5 to 50 μm, and discloses a method for producing the titanium alloy. Patent Document 6 discloses a titanium plate for a drum for producing electrolytic Cu foil that has a chemical composition containing Cu and Cr, and small amounts of Fe and O, and discloses a method for producing the titanium plate. This document describes an example in which annealing is performed at 630 to 870° C.

Patent Documents 7 and 8 disclose techniques that prepare a titanium having a chemical composition containing Si and Al, decrease the rolling reduction of cold rolling to 20% or lower, and increase annealing temperature to 825° C. or higher and a β transformation point or lower, which is a higher temperature condition, so as to make an average grain size 15 μm or larger.

LIST OF PRIOR ART DOCUMENTS

Patent Document

Patent Document 1: JP4088183B
Patent Document 2: JP2010-031314A
Patent Document 3: JP2010-202952A
Patent Document 4: JP4486530B
Patent Document 5: JP4061211B
Patent Document 6: JP4094395B
Patent Document 7: JP4157891B
Patent Document 8: JP4157893B

SUMMARY OF INVENTION

Technical Problem

Containing alloying elements to make crystal grains fine, as in the techniques disclosed in Patent Documents 2 to 4, is not enough to provide both excellent workability and high strengthening. In addition, in the producing method that coarsens crystal grains, as in the techniques disclosed in Patent Documents 5 to 8, there is no report about a technique that is of high-versatility and curbs an increase in cost.

In particular, the producing methods disclosed in Patent Documents 5 and 6 are of a batch type and take times as long as one hour or longer, which raises a problem of productivity in sheet coil production. In addition, both techniques control Fe to low contents. In the case of producing a titanium plate using scrap as a raw material by recycling, the content of Fe is increased owing to Fe in the scrap, and thus it is difficult to produce a titanium plate in which Fe is controlled at a low content. Therefore, to produce the titanium plate described in Patent Document 5 or Patent Document 6 by recycling, a constraint of using a scrap having a low content of Fe, or the like, is needed.

In addition, in the case of producing a sheet having a material quality of being excellent in workability, such as a titanium product used for plate heat exchangers and the like, products can be produced from a hot-rolled plate by performing cold rolling and annealing once. The grain coarsening treatments as disclosed in Patent Documents 7 and 8 increase the number of times of cold rolling and annealing, which thus involves a problem of an increase in cost.

An objective of the present invention is to provide a titanium sheet that is excellent particularly in balance between ductility and strength, and to provide a method for producing a high-strength titanium sheet that has an excellent productivity.

Solution to Problem

According to Patent Documents 2 to 4, in providing a titanium material with high strength, refining of crystal grains, addition of alloying elements, and the like are effective. Thus, to achieve the objective, the present inventors performed the addition of alloying elements and the control of crystal grains, and studied an influence on the enhancement of strength and twinning deformation. As a result, the following findings were obtained.

(1) The content of alloying elements and a crystal grain size were controlled for a pure titanium, and it was found that the balance of strength and ductility is further improved by adding alloying elements to coarsen crystal grains, rather than refining crystal grains.

(2) In addition, it was found that Cu and Ni make the growth of crystal grains during annealing harder to suppress than other alloying elements, and are alloying elements suitable for grain coarsening. The reason why the grain growth is hard to suppress is that metal micro-structures substantially turn into a single phase during the annealing. However, an excessive addition of these elements leads to the generation of one or both of intermetallic compounds with Ti and β phase, and thus the grain growth is inhibited, which suppresses twinning deformation. Here, in general, solid-solution strengthening is proportional to the square root of a number ratio (at %) of alloying elements. For this reason, if these elements are excessively added, efficient strengthening cannot be expected, intermetallic compounds such as $Ti_2Cu$ are likely to precipitate, and which may fail to provide an amount of strengthening as expected. Consequently, to establish the compatibility between excellent workability and strength, it is necessary to adjust the total content of these elements.

(3) Furthermore, even with the same composition and the same grain size, performing annealing at a low temperature has a tendency to suppress the occurrence of twinning deformation. That is, by containing Cu and Ni within a range of solid-solubility thereof in a phase, and by a coarsening crystal grain size at a temperature at which Cu and Ni can be dissolved sufficiently, twinning deformation is promoted, and it is possible to obtain a titanium sheet having excellent workability and high strength.

(4) In addition to (3) described above, an excessively low annealing temperature leads to the generation of $Ti_2Cu$ or $Ti_2Ni$, which inhibits the grain coarsening of α phase. Thus, the conditions under which these compounds are not generated were studied in detail. As a result, a finding was accidentally obtained that, in a Ti—Cu—Ni-based titanium alloy, a close relation exists between the contents of Cu and Ni, and a lower limit value of the annealing temperature, and an optimal lower limit value of the annealing temperature exists in accordance with the contents of these elements.

(5) By setting the temperature range for final annealing described above, a predetermined grain size is obtained in a short time, which enhances productivity.

Here, the present invention is as follows.

[A] A titanium sheet comprising a chemical composition containing, in mass %:

Cu: 0.1 to 1.0%;

Ni: 0.01 to 0.20%;

Fe: 0.01 to 0.10%;

O: 0.01 to 0.10%;

Cr: 0 to 0.20%; and the balance: Ti and unavoidable impurities, and satisfying $0.04 \leq 0.3Cu+Ni \leq 0.44\%$, wherein an average grain size of α phase is 15 μm or larger, and intermetallic compounds of Cu and/or Ni, and Ti is at 2.0 volume % or less.

[B] The titanium sheet according to the above [A], wherein an elongation [%] is 42% or higher, and a following formula (1) is satisfied.

$$(\text{Elongation})[\%] \geq -0.12 \times (0.2\%\ \text{yield stress})[\text{MPa}]+73 \quad (1)$$

[C] The titanium sheet according to the above [A] or [B], wherein the chemical composition contains, in mass %, Cr: 0.01 to 0.20%.

[D] A method for producing the titanium sheet according to any one of the above [A] to [C] by performing hot working, pickling, cold working, and final annealing on a titanium product, wherein the final annealing is performed at a temperature T (° C.) satisfying a following formula (2) when the chemical composition is $0.1\% \leq Cu \leq 0.8\%$, or when the chemical composition is $0.8\% < Cu \leq 1.0\%$ and $0.01 \leq Ni \leq 0.09\%$, and performed at a temperature T (° C.) satisfying a following formula (3) when the chemical composition is $0.8\% < Cu \leq 1.0\%$ and $0.09\% < Ni \leq 0.20$:

$$210[\text{Ni}\ \%]+665 \leq T \leq 890-340[\text{Ni}\ \%]-15[\text{Cu}\ \%]-800[\text{Fe}\ \%]-200[\text{Cr}\ \%] \quad (2)$$

$$-0.0037[\text{Ni}\ \%]^{-4}+7355 \leq T \leq 5890-340[\text{Ni}\ \%]-15[\text{Cu}\ \%]-800[\text{Fe}\ \%]-200[\text{Cr}\ \%] \quad (3)$$

where, in the formula (2) and the formula (3), [Ni %], [Cu %], [Fe %] and [Cr %] represent contents of Ni, Cu, Fe and Cr (mass %) in the titanium plate, respectively.

Advantageous Effects of Invention

According to the present invention, it is possible to provide a titanium sheet that has excellent workability and high strength, and to provide a method for producing a titanium sheet that has an excellent productivity.

DESCRIPTION OF EMBODIMENTS

The present invention will be described in detail. Note that "mass %" will be hereinafter simply denoted by "%".

1. Titanium Sheet (1) Details of Obtaining the Chemical Composition According to the Present Invention The present inventors conducted studies using titanium products having the chemical compositions shown in Table 1 and Table 2.

First, constituent elements to be added to a Ti alloy were studied. Test materials were fabricated by the arc melting, subjected to hot rolling at 1000° C. and 800° C., at a rolling reduction of 50% or higher, respectively, descaled, subjected to cold rolling at a rolling reduction of 70%, and formed into titanium sheets of 1 mm. From hot-rolled plates at this point, samples for component analysis were extracted, and the chemical compositions thereof were analyzed.

TABLE 1

| | Cu | Cr | Ni | Fe | O |
|---|---|---|---|---|---|
| Pure Ti | — | — | — | 0.03 | 0.05 |
| 0.3Cu | 0.31 | — | — | 0.01 | 0.05 |
| 0.5Cu | 0.50 | — | — | 0.01 | 0.05 |
| 0.07Cr | — | 0.07 | — | 0.01 | 0.05 |
| 0.15Cr | — | 0.15 | — | 0.01 | 0.05 |
| 0.13Ni | — | — | 0.13 | 0.01 | 0.05 |

Figure 1:
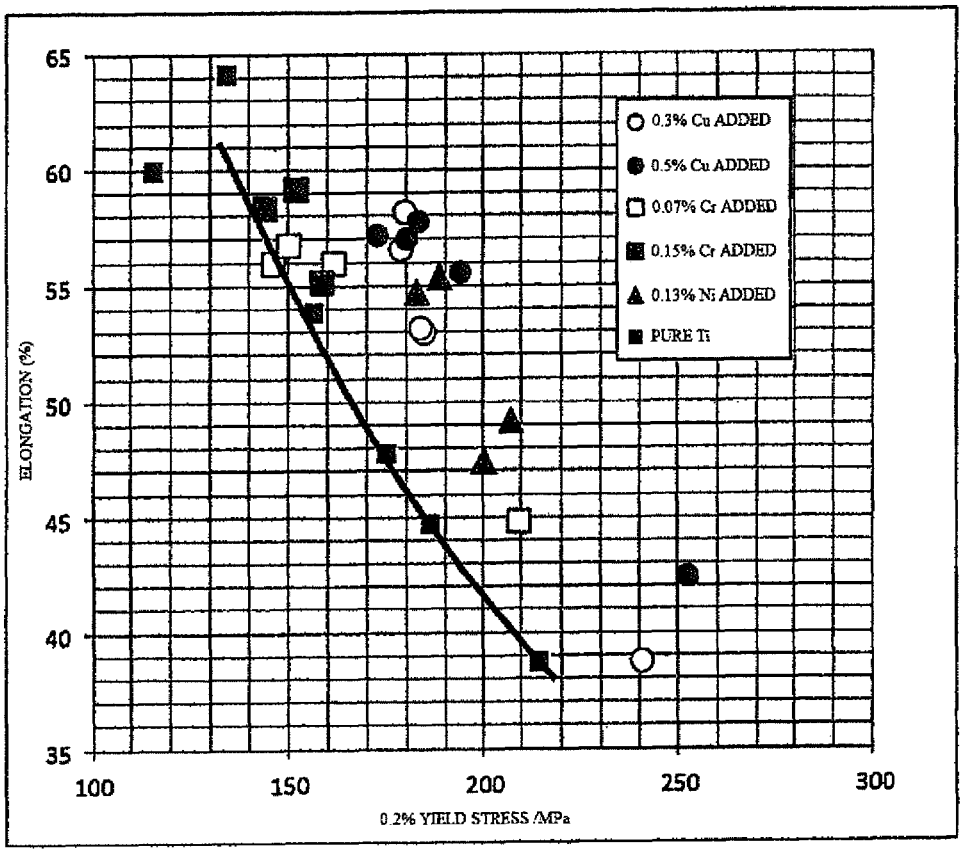
FIG. 1 is a graph illustrating the relation between 0.2% yield stress and elongation in titanium sheets in which various alloying elements are added.

These titanium sheets of 1 mm were subjected to heat treatment at 750° C. for 1 to 30 minutes, subjected to air cooling, and formed into titanium sheets having an average grain size of 10 to 60 μm. These titanium sheets were worked into ASTM half-size specimens and underwent tension test at room temperature in a direction (L direction) parallel to a rolling direction. The tension test was conducted on the conditions that a strain rate was 0.5%/min until 0.2% yield stress was reached, and was 20%/min until rupture occurs thereafter. The results are illustrated in FIG. 1. The average grain size under these conditions with each composition was 5 to 70 μm with a pure titanium, 8 to 40 μm with 0.3Cu, 7 to 43 μm with 0.5Cu, 10 to 56 μm with 0.07Cr, 36 to 52 μm with 0.15Cr, and 13 to 50 μm with 0.13Ni.

As illustrated in FIG. 1, the results of grain coarsening and adding alloying elements are shifted toward an upper right hand side from a solid line, which illustrates the result of the grain refining of a pure titanium, and thus it was found that the grain coarsening is excellent in strength-ductility balance.

Next, each β stabilizing element was added to a Ti alloy, and the relation between grain size and annealing temperature was investigated. The specimens having the chemical compositions shown in Table 2 were formed into titanium sheets of 1 mm by the same method as with the specimens having the chemical compositions shown in Table 1.

TABLE 2

| Chemical composition (mass %) | | | | | | | | | Grain size (μm) |
|---|---|---|---|---|---|---|---|---|---|
| Cu | Cr | Ni | Si | Co | Mo | V | Fe | O | 750° C. × 30 min |
| — | — | — | — | — | — | — | 0.03 | 0.04 | 72 |
| 1.06 | — | — | — | — | — | — | 0.01 | 0.07 | 60 |
| 1.51 | — | — | — | — | — | — | 0.01 | 0.08 | 15 |
| — | 0.18 | — | — | — | — | — | 0.01 | 0.09 | 48 |
| — | — | 0.15 | — | — | — | — | 0.01 | 0.08 | 90 |
| — | — | — | 0.08 | — | — | — | 0.01 | 0.05 | 38 |
| — | — | — | — | 0.11 | — | — | 0.01 | 0.07 | 21 |
| — | — | — | — | — | 0.31 | — | 0.02 | 0.15 | 9 |
| — | — | — | — | — | — | 1.05 | 0.01 | 0.11 | 26 |

The underline indicates that the value fell out of the range defined in the present invention.

These titanium sheets of 1 mm were subjected to heat treatment at 750° C. for 30 minutes and subjected to air cooling, and the average grain sizes thereof were measured by the method to be described later. The chemical compositions shown in Table 2 were made to include contents that allow ac single phase to be obtained in a binary equilibrium diagram.

As shown in Table 2, it was found that, out of all the various β stabilizing elements, Cu- and Ni-added titanium alloys can provide a grain size close to that of a pure titanium. Meanwhile, Mo-, Co-, and V-added titanium alloys resulted in small grain sizes. It is considered that this is because second phases might have been prone to precipitate, and thus the grain growth was suppressed. Therefore, it was found that alloying elements that make coarse crystal grains easy to obtain are Cu and Ni, followed by Cr. However, an excessive addition leads to the inhibition of the grain growth, and thus by containing Cu and Ni within the solid-solubility range so that the grain growth is not inhibited, and by grain coarsening, it is possible to provide a titanium sheet excellent in strength-ductility.

The chemical composition according to the present invention determined in such a manner is as follows.

(2) Chemical Composition

Cu: 0.1 to 1.0%

Cu has a wide solid-solubility limit in ac phase of about 2% at maximum. However, an excessive addition of Cu leads to a significant suppression of grain growth even in a single-phase structure. In addition, an excessive addition of Cu increases the risk of the occurrence of a significant segregation, and thus the upper limit value of the content of Cu is set at 1.0%. The upper limit value is preferably 0.95% or less, more preferably 0.92% or less, even more preferably 0.90% or less, particularly preferably 0.87% or less, and most preferably 0.85% or less. On the other hand, a small content of Cu results in a small effect of high strengthening. The lower limit value of the content of Cu is set at 0.10%. The lower limit value is preferably 0.20% or more, more preferably 0.25% or more, even more preferably 0.30 or more, and particularly preferably 0.50% or more.

Ni: 0.01 to 0.20%

Ni has an effect of promoting grain growth. However, Ni has a small solid-solubility limit in α phase, and thus an excessive addition of Ni results in the inhibition of grain growth as with Cu. The upper limit value of the content of Ni is set at 0.20%. The upper limit value is preferably 0.18% or less, more preferably 0.15% or less, even more preferably 0.12% or less. On the other hand, to exert the effect of promoting grain growth and the effect of high strengthening, the lower limit value of the content of Ni is set at 0.01%. The lower limit value Ni is preferably 0.03% or more, more preferably 0.05% or more.

0.3Cu+Ni: 0.04 to 0.44

Figure 2A:
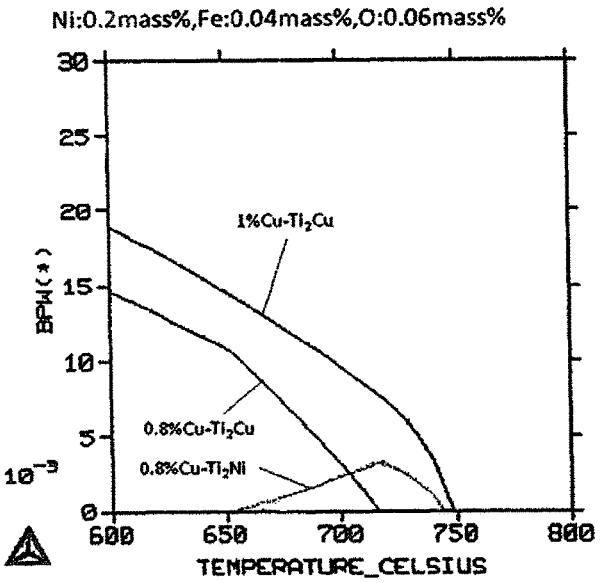
FIG. 2 is graphs illustrating the phase ratio in Ti—Cu—Ni-based alloys at 600° C. to 800° C. calculated by Thermo-calc. (Thermotech Ti-based Alloys Database version 3.0), where FIG. 2(*a*) is a graph illustrating the phase ratios of $Ti_2Cu$ and $Ti_2Ni$ when the content of Cu is changed, and FIG. 2(*b*) is a graph illustrating the phase ratio of $Ti_2Cu$ when the content of Ni is changed.
Figure 2B:
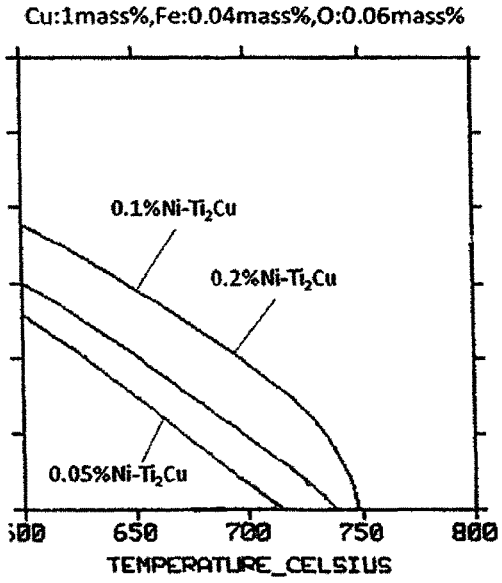

As illustrated in FIG. 2, as the contents of Ni and Cu increase, the precipitation starting temperatures of $Ti_2Cu$ and the like increase. Therefore, an excessive addition of Ni and Cu results in not only the inhibition of crystal grain growth but also a failure to obtain an expected amount of strengthening owning to a decrease in solubility by the precipitation. In general, solid-solution strengthening is in proportion to the square root of the number ratio (at %) of elements, and thus the risk of the inhibition of the crystal grain growth surpasses the amount of strengthening. For such a reason, it is necessary to limit the total sum of the contents of Cu and Ni.

Figure 3:
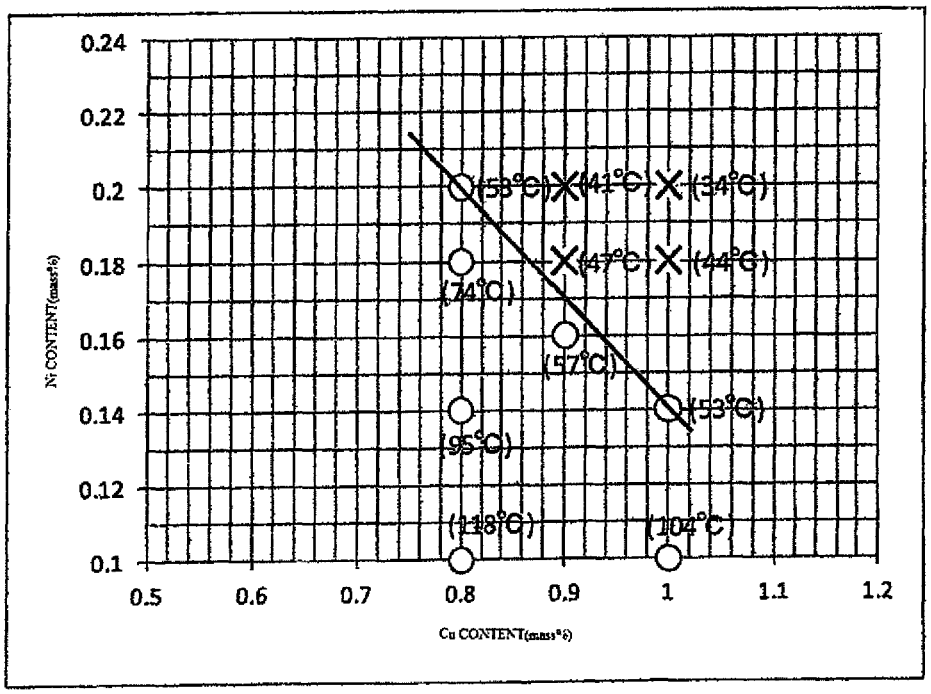
FIG. 3 is a graph illustrating the relation between the contents of Cu and Ni and (upper limit temperature of annealing $T_l$)−(precipitation starting temperature $T_s$) in Ti—Cu—Ni-based alloys.

In consideration of the influence of segregation and the variations in annealing temperature, in order to dissolve Cu or Ni sufficiently, it is desirable that a sufficient difference exists between a temperature $T_s$ at which the total sum of precipitation amounts of $Ti_2Cu$ and $Ti_2Ni$ is 2.0% or less (precipitation starting temperature) and an upper limit temperature of annealing $T_1$ to be described later. FIG. 3 is a graph illustrating the relation between the contents of Cu and Ni, and (upper limit temperature of annealing $T_1$)−(precipitation starting temperature $T_s$) in $T_1$—Cu—Ni-based alloys. The chemical composition studied in FIG. 3 was Fe: 0.05% by mass, O: 0.05% by mass, Cu and Ni: the contents illustrated in FIG. 3, and the balance being Ti. As illustrated in FIG. 3, the total of the contents of Cu and Ni that satisfy 50° C.≤$T_1-T_s$ needs to meet the formula (6).

$$0.04\% \leq 0.3[\text{Cu }\%]+[\text{Ni }\%] \leq 0.44\% \quad (6)$$

In the formula (6), [Cu %] and [Ni %] represent the content of Cu and Ni (mass %) in a titanium plate, respectively.

The upper limit value of the total is preferably 0.42%, more preferably 0.40%, and even more preferably 0.38%. Cu and Ni both strengthen a titanium product by solid-solution strengthening. The lower limit value of the total is preferably 0.08%, more preferably 0.10%, and even more preferably 0.15%, and particularly preferably 0.20%.

Fe: 0.01 to 0.10%

With an excessive addition, Fe stabilizes β phase and obstructs grain growth during annealing. The upper limit value of the content of Fe is set at 0.10%. The upper limit value is preferably 0.08% or less, more preferably 0.07% or less, and even more preferably 0.06% or less. Fe is inevitably contained in an industrial manner, and thus the lower limit value of the content of Fe is set at 0.01%.

O: 0.01 to 0.10%

With an excessive addition, O suppresses the occurrence of twinning deformation. The upper limit value of the content of O is set at 0.10%. The upper limit value is preferably 0.09% or less, more preferably 0.08% or less, even more preferably 0.075% or less, and particularly preferably 0.07% or less. O is inevitably contained in an industrial manner, and thus the lower limit value of the content of O is set at 0.01%. However, an excessively low content of O results in a decrease in strength, and thus the lower limit value is preferably 0.03% or more, more preferably 0.04% or more, and even more preferably 0.05%.

Cr: 0 to 0.20%

Cr is comparatively less obstructive to grain growth, and thus Cr may be contained at an upper limit of 0.20%. To prevent the hindrance of the grain growth, the content of Cr is preferably set at 0.01 or more.

The Balance: Ti and Unavoidable Impurities

Besides the above elements, the balance consists of Ti and unavoidable impurities. In the production of a titanium sheet, use may be made of a scrap raw material from the viewpoint of promoting recycling. Thus, various impurity elements are mixed in the titanium sheet. For this reason, it is difficult to determine the contents of the impurity elements uniquely. Therefore, the impurities in the present invention mean elements that are contained in amounts in which the operational advantage of the present invention is not inhibited. Examples of such unavoidable impurities include N: 0.03% or less and C: 0.03% or less.

(3) Twin Occurrence Frequency

For pure titaniums or titanium low alloys, it is effective for the enhancement of workability to increase work hardening rate. To enhance the work hardening rate of a titanium product, the activation of twinning deformation is important. This is because twin boundaries introduced by the twinning deformation are obstacles for the movement of dislocation, as with crystal grain boundaries. For such a reason, for the improvement of workability, the activation of twinning deformation, namely, coarsening of crystal grains is important. However, as for the twinning deformation, there are other influencing factors such as chemical composition other than crystal grain size, it is desirable to evaluate the degree of activation of twinning deformation. Thus, as an index indicating the activation degree of twinning deformation, a twin occurrence frequency is defined. The twin occurrence frequency is "the average of the number of deformation twins per crystal grain present in a metal micro-structure observed in a cross section in a direction perpendicular to a rolling direction, after loading 5% of tensile deformation (elastic deformation+plastic deformation) in a direction parallel to the rolling direction and unloading".

As for the twin occurrence frequency, the degrees of suppression by Cu, Cr, and Ni are low in comparison with those of normally used strengthening elements such as O and Al. That is, the addition of Cu, Cr, or Ni is suitable to keep workability while strengthening titanium.

(4) 15 μm or Larger Average Grain Size of α Phase

When the average grain size of α phase is small, ductility cannot be secured because twinning deformation is suppressed. To secure a sufficient ductility, the average grain size is set at 15 μm or larger. The average grain size is preferably 20 μm or larger, more preferably 25 μm or larger, even more preferably 30 μm or larger, particularly preferably 35 μm or larger, and most preferably 40 μm or larger. In particular, in the case of an oxygen concentration as low as 0.01 to 0.05%, the average grain size of α phase is preferably 15 to 50 μm. This case is excellent particularly in the balance between yield stress and elongation.

The average grain size is determined by square approximation using planimetry from a visual field including 100 or more crystal grains observed in a cross section under an optical microscope. The metal micro-structure of the titanium sheet according to the present invention is substantially of a single phase.

(5) 2.0 Volume % or Less of Intermetallic Compounds of Cu and/or Ni, and Ti

The intermetallic compound of Cu and/or Ni, and Ti contains Cu and/or Ni at a high concentration and decreases the amount of solid-solution strengthening. Therefore, the intermetallic compound needs to be suppressed. For this reason, the intermetallic compound of Cu and/or Ni, and Ti is set at 2.0 volume % or less. The intermetallic compound is more desirably 1.5 volume % or less, and even more desirably 1.0 volume % or less. The most desirable is a state that no intermetallic compounds are present (i.e., 0 volume %).

The presence of β phase also gives rise to the distribution of elements as with the intermetallic compound, which decreases the solubilities of Cu and Ni in α phase. However, the amount of decreasing is small in comparison with the intermetallic compound, and an influence contributing to the suppression of grain growth is larger than an influence contributing to the decrease in solubilities. That is, the presence of β phases raises no problem as long as the presence is to the extent to which grain growth is not obstructed. A β phase ratio for preventing the inhibition of grain growth will be described later.

The titanium sheet according to the present invention is made to have an average grain size of c phase of 15 μm or larger and have a metal micro-structure in which the intermetallic compound is suppressed by defining the contents of Cu, Ni, Fe, and O, and defining the total content of Cu and Ni that generates one or both of the intermetallic compound with Ti and β phase, and by producing the titanium sheet under producing conditions to be described later. In general, 0.2% yield stress and elongation are in a trade-off relation, and thus a high 0.2% yield stress results in a decrease in workability. However, in the present invention, by satisfying all conditions of the chemical composition and the crystal grain size mentioned before, and the producing conditions to be described later, it is possible to overcome this trade-off relation, which cannot be done by conventional techniques.

(6) Mechanical Characteristic

The titanium plate according to the present invention has a mechanical characteristic that satisfies the following formula (1) within a range of elongation of 42.0% or higher.

$$(\text{Elongation})\ [\%] \geq -0.12 \times (0.2\%\ \text{yield stress})[\text{MPa}] + 73 \quad (1)$$

In the present invention, what is desired to reduce the wall thickness and weight of a titanium plate used in particular for a plate-type heat exchanger is to keep excellent workability that allows press forming of a complex shape, while being high-strength. In general, 0.2% yield stress and elongation are in a trade-off relation. However, in the present invention, by having a specific chemical composition and crystal grain size as mentioned before, it is possible to make plastic deformation hard to occur in use, while showing excellent workability in forming. Further, in the present invention, 0.2% yield stress is desirably within a range of 190 MPa or higher. With this condition, the titanium sheet according to the present invention has an excellent mechanical characteristic that strikes the balance of both.

Figure 4:
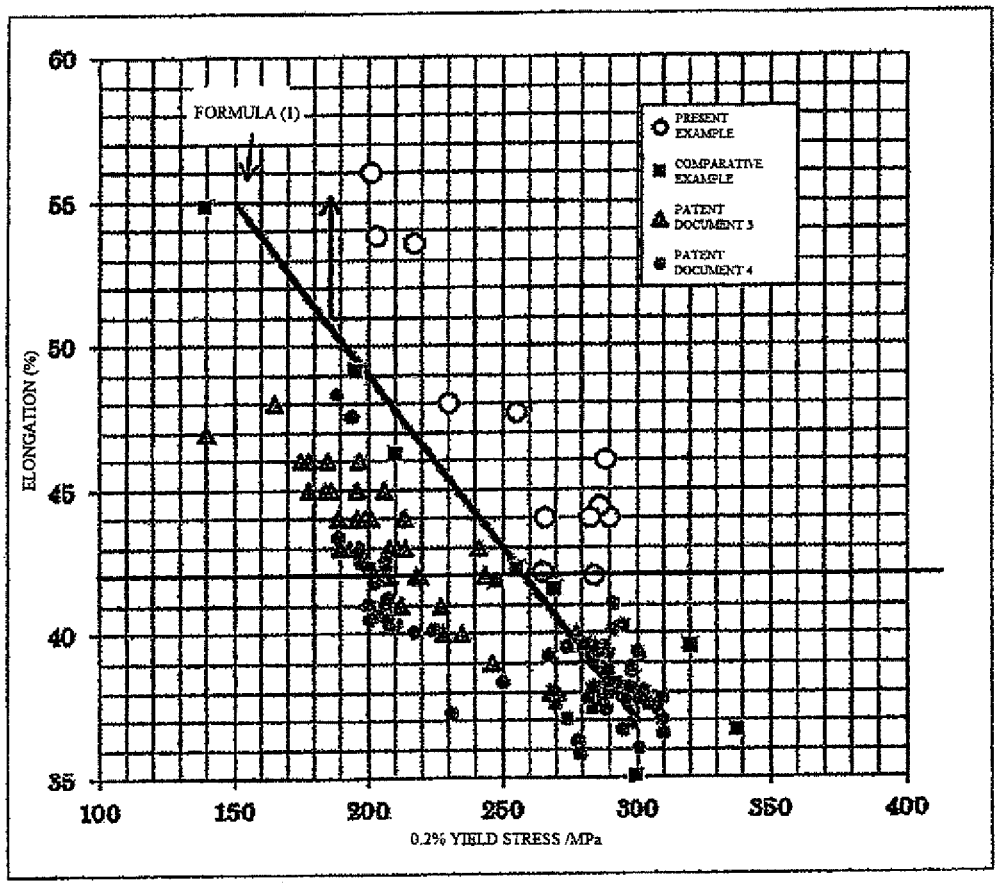
FIG. 4 is a graph illustrating the relation between 0.2% yield stress and elongation for the present examples, the comparative examples, and the results disclosed in Patent Document 3 and Patent Document 4.

For example, when a pure titanium is strengthened by refining crystal grains, there is a region where the elongation rapidly decreases with an increase in 0.2% yield stress. This is a region representing the "trade-off relation" mentioned before, which is a region illustrated by a comparative example in FIG. 5 to be described later, and described in Patent Document 3 and Patent Document 4. In addition, in the region where the elongation rapidly decreases with respect to the 0.2% yield stress, the relation between the elongation and the 0.2% yield stress can be subjected to linear approximation. Thus, in the present invention, as illustrated in FIG. 4, a region that is expressed by the formula (1) of the present invention with the elongation being 42% or higher is defined in the region where the elongation rapidly decreases in conventional practices, as a region where the compatibility between an excellent 0.2% yield stress and elongation is established.

(7) Plate Thickness of Titanium Sheet

The present invention is used in particular for an application such as plate heat exchangers. In the present invention, a "sheet" may have a plate thickness of about 0.3 to 1.5 mm.

2. Producing Method (1) Hot Rolling, Annealing, Cold Rolling

A base metal to be subjected to hot rolling in the present invention is produced by the vacuum arc remelting (VAR) or the electron beam remelting (EBR). The resulting ingot is subjected to surface cutting as necessary, heated to about 800 to 1100° C., and subjected to hot working. The hot working refers to hot forging and hot rolling (including blooming). The ingot is subjected to surface cutting as necessary, heated to a temperature range of about 800 to 1100° C., and subjected to hot rolling at a rolling reduction of 50% or higher, whereby a hot-rolled plate is produced. Afterward, the hot-rolled plate is annealed within a range of 600 to 850° C., subjected to pickling treatment as conventionally practiced, subjected to scale removal, and subjected to cold working at a rolling ratio of 50 to 95%, whereby a cold-rolled plate of 0.3 to 1.5 mm is produced.

(2) Annealing

The cold-rolled plate produced in the manner mentioned before is subjected to final annealing. In conventional practices, the annealing is performed in a batch manner or a continuous manner. In the batch manner, the cold-rolled plate is annealed as it is wounded as a coil, and there is the risk of bonding. For this reason, while in the batch manner, the annealing needs to be performed at a temperature lower than that in the continuous manner, it needs to be performed at less than 750° C. in order to avoid the bonding of titanium plates. Therefore, as long as an annealing temperature is less than 750° C., the annealing may not be performed in the continuous manner. The annealing time is reduced in the continuous manner, it is necessary to increase the annealing temperature to promote grain growth. Here, the present inventors determined the annealing temperature as follows.

Table 3 shows the average grain sizes of titanium plates having chemical compositions containing Cu and/or Ni that are retained within a temperature range of 700 to 800° C. for 30 minutes using a continuous annealing furnace.

TABLE 3

| Chemical composition (mass %) | | | | Annealing temperature (° C.) | | | |
|---|---|---|---|---|---|---|---|
| Cu | Ni | Fe | O | 700 | 750 | 770 | 800 |
| 1.06 | — | 0.01 | 0.07 | 14 | 60 | — | 116 |
| — | 0.15 | 0.01 | 0.08 | 27 | 90 | — | 124 |
| 0.52 | 0.10 | 0.01 | 0.05 | 18 | 63 | 78 | 107 |
| 0.30 | 0.10 | 0.01 | 0.05 | 21 | 66 | 86 | 111 |
| 0.82 | 0.10 | 0.06 | 0.07 | 18 | 32 | 36 | 16 |
| 0.29 | 0.15 | 0.07 | 0.05 | 12 | 35 | 41 | 21 |
| 0.78 | 0.15 | 0.06 | 0.06 | 15 | 31 | 39 | 14 |

The underline indicates that the value fell out of the range defined in the present invention.

As shown in Table 3, grains are not always coarsened as the annealing is performed at a higher temperature. An optimal temperature for the annealing exists in accordance with chemical composition. In particular, such a phenomenon is likely to occur in the case of a high content of Fe or Ni. In some cases, a grain size of 15 μm or larger cannot be obtained even when heat treatment is performed at 800° C. Therefore, it is necessary to determine an annealing temperature in accordance with chemical composition.

The present inventors performed annealing at various temperatures, with the result that, in an equilibrium diagram obtained from Thermo-calc. (Thermotech Ti-based Alloys Database version 3.0), it was found that, at a temperature at which β phase is present at 1 to 2%, grain growth was inhibited by pinning. Then, a temperature at which β phase is present at 1 to 2% was determined with various chemical compositions, and the relation between chemical composition and temperature was determined by the multiple regression analysis. Coefficients obtained by the multiple regression analysis were −1300 to −350, −500 to −200, −20 to +5, and −300 to −100 in order of Fe, Ni, Cu, and Cr, respectively. Then, the present inventors found coefficients within these ranges with which the experimental results can be reproduced, and succeeded in determining an annealing temperature in accordance with chemical composition.

As can be seen from the above, in the present invention, by determining the upper limit value of a final annealing temperature in accordance with chemical composition, it is also possible to secure an excellent productivity. While the treatments shown in Table 3 were performed at each temperature for 30 minutes, as mentioned before, times taken to reach the grain sizes shown in Table 3 significantly differ. For example, Ti-0.78Cu-0.15Ni shown in the bottom row Table 3 takes 40 minutes to reach 15 μm at 800° C., but the same grain size can be obtained in about 1 minute at 750° C. although it is a low temperature. The productivity increases by 40 min/1 min=40 times, which is a tremendous enhancement.

As can be seen from the above, according to the techniques as of the application of the present invention, the annealing temperature is set at a high temperature to promote grain growth, but in some cases, performing the treatment at a low temperature rather promotes grain growth, depending on chemical composition. To coarsen grains in a metal micro-structure, the present invention has been accomplished through the study in an opposite way to conventional studies.

Further, in the present invention, in addition to the upper limit value of the final annealing temperature, the lower limit value is also optimized in accordance with chemical composition so as to coarsen grains. In final annealing, setting the upper limit temperature as well as the lower limit temperature is important to produce an excellent product with stability. In conventional practices, coarsening crystal grains is dealt with by increasing a temperature as high as possible. However, when a treatment temperature is simply increased, the coarsening is obstructed by 3 phase as mentioned before. In addition, grain growth is suppressed at a low temperature to begin with, and when intermetallic compounds and the like precipitate, the grain growth is further suppressed. However, if the grain growth is not inhibited by intermetallic compounds, coarse crystal grains can be obtained by a long-time annealing even at a low temperature as in the batch manner. Therefore, it is necessary to set the lower limit temperature at a temperature at which intermetallic compounds do not influence grain growth.

Hence, the precipitation temperatures of these compounds were studied in detail. As a result, it was found that providing an appropriate lower limit value in accordance with chemical composition allows the precipitation of these compounds to be suppressed.

Figure 5:
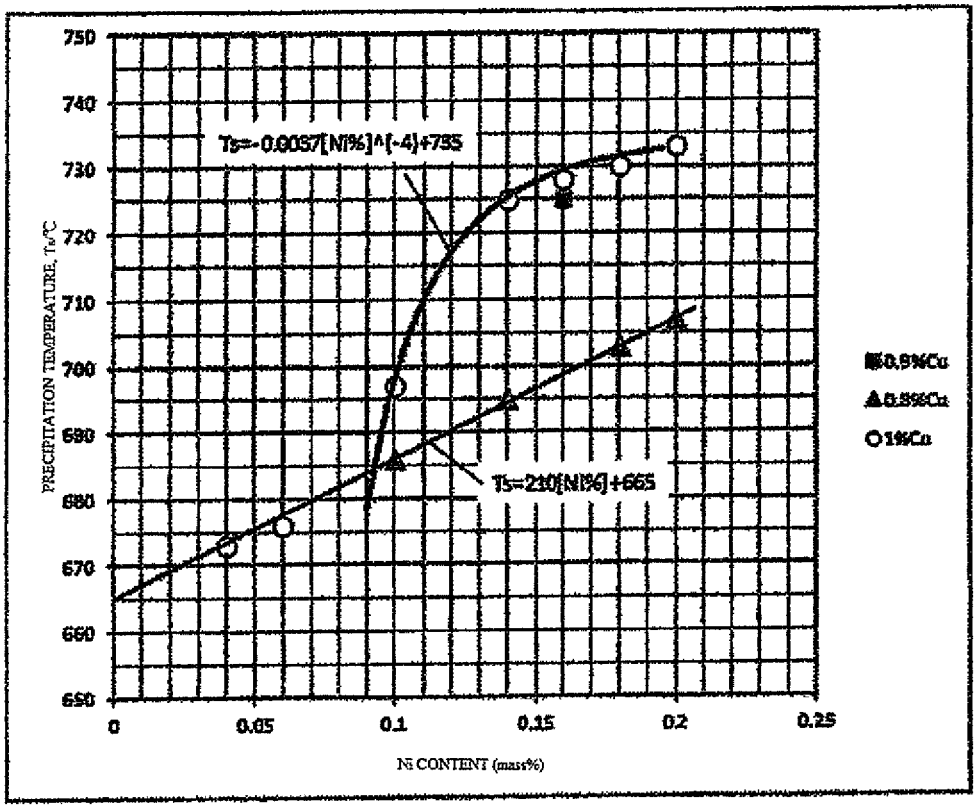
FIG. 5 is a graph illustrating the relation between the content of Ni and precipitation temperature when the content of Cu in a Ti—Ni—Cu-based titanium alloy is changed.

FIG. 5 is a graph illustrating the relation between the content of Ni and precipitation temperature when the content of Cu in a Ti—Ni—Cu-based titanium alloy is changed. This precipitation temperature refers to the precipitation temperature of $Ti_2Cu$ or $Ti_2Ni$. As can be seen in FIG. 5, as the content of Ni is increased, the precipitation temperature increases linearly until when the content of Ni is about 0.09%, and then the difference in the increasing tendencies of the precipitation temperature is significant across a diverging point at which the content of Ni is about 0.09%. This may be inferred as follows: β phase increases as the temperature increases from about 700° C. to a high temperature, and Cu and Ni, which are 0 stabilizing elements, are dissolved in the 3 phase. As a result, $Ti_2Cu$ or $Ti_2Ni$ precipitating in α phase or β phase decreases. In addition, there is a temperature region where β phase rapidly increases, and in the vicinity of the temperature, $Ti_2Cu$ or $Ti_2Ni$ rapidly decreases. In addition, Ni has a higher degree of priority of being dissolved in β phase, and thus $Ti_2Ni$ decreases first. For such a thermodynamic reason, in the addition range of Ni of the present invention, the precipitation temperature can be subjected to linear approximation with respect to the amount of Ni amount as long as Cu is at up to 0.8%, while the linear approximation becomes unable when the amount of Cu increase.

Such a range of the annealing temperature needs to satisfy the formula (A) and the formula (B) in the continuous annealing where the annealing is performed at a high temperature for a short time when Cr is not contained.

When Cu≤0.8%, or when 0.8%<Cu≤1% and Ni≤0.09%, $$210[\text{Ni }\%]+665<T\leq 890-340[\text{Ni }\%]-15[\text{Cu }\%]-800[\text{Fe }\%] \quad (A)$$

When 0.8%<Cu≤1% and 0.09%<Ni, $$-0.0037[\text{Ni }\%]^{-4}+735<T\leq 890-340[\text{Ni }\%]-15[\text{Cu }\%]-800[\text{Fe }\%] \quad (B)$$

In the formula (A) and the formula (B), [Ni %], [Cu %], and [Fe %] represent the contents of Ni, Cu, and Fe (mass %) in a titanium plate, respectively.

In addition, from the results of Table 1 and Table 2, when Cr, which is comparatively less obstructive to grain growth, is contained, the formula (C) and the formula (D) need to be satisfied.

When Cu≤0.8%, or when 0.8%<Cu≤1% and Ni≤0.09%, $$210[\text{Ni }\%]+665\leq T\leq 890-340[\text{Ni }\%]-15[\text{Cu }\%]-800[\text{Fe }\%]-200[\text{Cr }\%] \quad (C)$$

When 0.8%<Cu≤1% and 0.09%<Ni, $$-0.0037[\text{Ni }\%]^{-4}+735\leq T\leq 890-340[\text{Ni }\%]-15[\text{Cu }\%]-800[\text{Fe }\%]-200[\text{Cr }\%] \quad (D)$$

In the formula (C) and the formula (D), [Ni %], [Cu %], [Fe %], and [Cr %] represent the contents of Ni, Cu, Fe, and Cr (mass %) in a titanium plate, respectively.

The reason for setting the annealing temperature at the left side of each of the above formulas and higher is that if the annealing temperature is set at less than the left side of each formula, the precipitation of $Ti_2Cu$ and the like leads to a decrease in amount of strengthening owing to the addition of Cu as mentioned before. Additionally, ductility also decreases, and setting a low temperature in the continuous annealing of a material containing alloying elements also leads to a longer annealing time and a decrease in workability owing to non-recrystallized structures remaining.

Meanwhile, in the batch manner, the reason is to cause $Ti_2Cu$ and the like to precipitate to prevent a decrease in amount of strengthening by the addition of Cu, and within a range of less than 750° C., the annealing can be performed by satisfying the above formulas (A) to (D).

The annealing time is not limited in particular and determined so as to provide a predetermined grain size, and from the viewpoint of recrystallization and productivity, the annealing time is about 0.5 to 30 minutes in the continuous manner and 1 to 24 hours in the batch manner.

In addition, the annealing, in the batch manner, may be performed in vacuum or in an inert gas atmosphere in order to suppress the oxidation of titanium. In the continuous manner, the annealing is performed in the air (after the annealing, pickling is performed as necessary), or in an inert gas atmosphere.

By satisfying the temperature range, time, and atmosphere mentioned above, it is possible to obtain an average grain size of 15 m or larger efficiently. However, although an average grain size of 15 lam or larger can be obtained by the annealing, when a cooling rate is low, intermetallic compounds precipitate in cooling. The precipitation of the intermetallic compounds is thermodynamically stable and occurs at a temperature that allows atomic diffusion. A temperature range at which the intermetallic compounds precipitate is 400° C. or higher and the lower limit temperature of the annealing (the left sides of the formulas (A) to (D)) mentioned before or lower. That is, a cooling rate within this temperature range is important.

Note that, when a titanium sheet having a plate thickness of 1 mm and having the chemical composition described in an Inventive example 9 in Example was allowed to be cooled in the air, the titanium sheet was cooled at 4 to 15° C./s within a range of 400° C. to the lower limit temperature of the annealing, which took about 60 seconds. In the metal micro-structure at this point, intermetallic compounds were present at about 2.2 volume %, and thus it is necessary to perform cooling for at least 60 seconds or shorter. When the cooling was performed for 55 seconds, intermetallic compounds were present at 1.9 volume %, and thus 55 seconds or shorter suffice. Not only by performing the annealing within a temperature range in accordance with chemical composition, but also performing the cooling at a predetermined cooling rate, it is finally possible to produce the titanium sheet according to the present invention.

Example

Base metals having the chemical compositions shown in Table 4 were fabricated by the are melting, subjected to 50% hot workings at 1000° C. and 800° C., respectively, descaled, subjected to 70% cold working, and formed into titanium sheets of 1 mm.

These titanium sheets were charged in an annealing furnace set at various temperatures shown in Table 4, in a vacuum atmosphere, and annealing equivalent to the continuous annealing was performed using an infrared heating furnace for a soaking time of 1 to 30 minutes (a time for which the titanium sheets were retained at a set temperature ±5° C.), and annealing equivalent to batch annealing was performed using a vacuum furnace for a soaking time of 1 to 10 hours (a time for which the titanium sheets were retained at a set temperature ±5° C.).

The cooling was gas cooling using an Ar gas in the continuous annealing equivalent, and was Ar gas cooling or furnace cooling in the batch annealing equivalent. Tension test was conducted using ASTM half-size specimens extracted from these sheets at a room temperature, and strength was evaluated in terms of 0.2% yield stress, and workability was evaluated in terms of elongation. The tension test was conducted on the conditions that a strain rate was 0.5%/min until 0.2% yield stress was reached, and was 20%/min until rupture occurs thereafter. In addition, the average grain size is determined by square approximation using planimetry from a visual field including 100 or more crystal grains observed in a cross section parallel to the rolling direction under an optical microscope, for all crystal grains in the visual field. The results are shown in Table 4.

TABLE 4

| | Chemical composition (balance: Ti and unavoidable impurities) | | | | | | Final annealing condition | | | | |
|---|---|---|---|---|---|---|---|---|---|---|---|
| | | | | | | | Temperature | | | Cooling | Staying time period |
| | Cu | Ni | Cr | Fe | O | 0.3Cu + Ni | (° C.) | ① | ② | method | (s)* |
| Comparative example 1 | — | — | — | 0.03 | 0.04 | 0 | 700 | 665.0 | 866.0 | Ar gas | 38 |
| Inventive example 1 | 0.51 | 0.05 | — | 0.01 | 0.05 | 0.20 | 750 | 675.5 | 857.4 | Ar gas | 38 |
| Comparative example 2 | 0.32 | 0.10 | — | 0.01 | 0.05 | 0.20 | 670 | 686.0 | 843.2 | Ar gas | 30 |
| Inventive example 2 | 0.50 | 0.10 | — | 0.01 | 0.05 | 0.25 | 750 | 686.0 | 840.5 | Ar gas | 41 |
| Comparative example 3 | 0.50 | 0.10 | — | 0.01 | 0.05 | 0.25 | 680 | 686.0 | 840.5 | Ar gas | 34 |
| Inventive example 3 | 0.31 | 0.14 | — | 0.01 | 0.05 | 0.23 | 750 | 694.4 | 829.8 | Ar gas | 42 |
| Inventive example 4 | 0.29 | 0.15 | — | 0.07 | 0.07 | 0.24 | 770 | 696.5 | 778.7 | Ar gas | 43 |
| Inventive example 5 | 0.78 | 0.15 | — | 0.07 | 0.06 | 0.38 | 770 | 696.5 | 771.3 | Ar gas | 43 |
| Comparative example 4 | 1.25 | 0.15 | — | 0.06 | 0.07 | 0.53 | 770 | 727.7 | 772.3 | Ar gas | 43 |
| Inventive example 6 | 0.51 | 0.10 | — | 0.07 | 0.07 | 0.25 | 770 | 686.0 | 792.4 | Ar gas | 43 |
| Inventive example 7 | 0.82 | 0.10 | — | 0.06 | 0.08 | 0.35 | 770 | 698.0 | 795.7 | Ar gas | 43 |
| Inventive example 8 | 0.81 | 0.05 | — | 0.10 | 0.07 | 0.29 | 770 | 675.5 | 780.9 | Ar gas | 43 |
| Comparative example 5 | 1.18 | 0.05 | — | 0.06 | 0.07 | 0.40 | 700 | 675.5 | 807.3 | Ar gas | 38 |
| Comparative example 6 | 0.85 | 0.10 | — | 0.05 | 0.11 | 0.36 | 770 | 698.0 | 803.3 | Ar gas | 43 |
| Comparative example 7 | 0.85 | 0.35 | — | 0.06 | 0.05 | 0.61 | 780 | 734.8 | 710.3 | Ar gas | 45 |
| Inventive example 9 | 0.82 | 0.10 | — | 0.06 | 0.08 | 0.35 | 750 | 698.0 | 795.7 | Ar gas | 41 |
| Comparative example 8 | 0.82 | 0.10 | — | 0.06 | 0.08 | 0.35 | 650 | 698.0 | 791.8 | Furnace cooling | 3000 |
| Comparative example 9 | 0.82 | 0.10 | — | 0.06 | 0.08 | 0.35 | 700 | 698.0 | 795.7 | Ar gas | 66 |
| Comparative example 10 | 0.85 | — | — | 0.06 | 0.11 | 0.26 | 750 | 665.0 | 829.3 | Ar gas | 53 |
| Comparative example 11 | — | 0.19 | — | 0.02 | 0.05 | 0.19 | 770 | 704.9 | 809.4 | Ar gas | 65 |
| Comparative example 12 | — | 0.19 | — | 0.02 | 0.05 | 0.19 | 770 | 704.9 | 809.4 | Ar gas | 62 |
| Comparative example 13 | 1.00 | 0.10 | 0.2 | 0.05 | 0.08 | 0.40 | 660 | 698.0 | 761.0 | Furnace cooling | 3000 |
| Inventive example 10 | 1.00 | 0.10 | 0.2 | 0.05 | 0.08 | 0.40 | 700 | 698.0 | 761.0 | Ar gas | 36 |
| Inventive example 11 | 1.00 | 0.10 | 0.2 | 0.05 | 0.08 | 0.40 | 720 | 698.0 | 761.0 | Ar gas | 53 |
| Inventive example 12 | 0.82 | 0.10 | 0.1 | 0.06 | 0.08 | 0.35 | 750 | 698.0 | 775.7 | Ar gas | 40 |

TABLE 4-continued

| | Final annealing condition Scheme | Grain size (μm) | Intermetallic compound (vol %) | 0.2% PS (MPa) | El (%) | Formula (1) |
|---|---|---|---|---|---|---|
| Comparative example 1 | Continuous-type equivalent | 38 | 0 | 140 | 54.8 | X |
| Inventive example 1 | Continuous-type equivalent | 37 | 0.2 | 201 | 56.0 | ○ |
| Comparative example 2 | Continuous-type equivalent | 11 | 1.1 | 248 | 41.8 | X |
| Inventive example 2 | Continuous-type eqpivalent | 63 | 0.4 | 217 | 53.6 | ○ |
| Comparative example 3 | Continuous-type equivalent | 9 | 0.4 | 285 | 37.4 | X |
| Inventive example 3 | Continuous-type equivalent | 63 | 0.2 | 203 | 53.8 | ○ |
| Inventive example 4 | Continuous-type equivalent | 18 | 0.6 | 265 | 42.2 | ○ |
| Inventive example 5 | Continuous-type equivalent | 16 | 0.7 | 286 | 44.4 | ○ |
| Comparative example 4 | Continuous-type equivalent | 9 | 0.5 | 338 | 36.6 | ○ |
| Inventive example 6 | Continuous-type equivalent | 20 | 0.9 | 255 | 47.7 | ○ |
| Inventive example 7 | Continuous-type equivalent | 18 | 1.2 | 288 | 46.0 | ○ |
| Inventive example 8 | Continuous-type equivalent | 16 | 0.9 | 284 | 42.0 | ○ |
| Comparative example 5 | Continuous-type equivalent | 13 | 0.9 | 321 | 39.5 | ○ |
| Comparative example 6 | Continuous-type equivalent | 19 | 0.6 | 289 | 39.1 | ○ |
| Comparative example 7 | Continuous-type equivalent | 12 | 1.8 | 296 | 33.0 | X |
| Inventive example 9 | Continuous-type equivalent | 25 | 0.8 | 283 | 44.0 | ○ |
| Comparative example 8 | Batch-type equivalent | 23 | 4.6 | 270 | 41.5 | ○ |
| Comparative example 9 | Batch-type equivalent | 14 | 4.8 | 281 | 39.6 | ○ |
| Comparative example 10 | Continuous-type equivalent | 25 | 1.9 | 300 | 35.0 | X |
| Comparative example 11 | Continuous-type equivalent | 49 | 3.8 | 196 | 49.1 | ○ |
| Comparative example 12 | Continuous-type equivalent | 17 | 2.8 | 211 | 46.2 | ○ |
| Comparative example 13 | Batch-type equivalent | 20 | 4.2 | 256 | 42.2 | ○ |
| Inventive example 10 | Continuous-type equivalent | 20 | 0.7 | 266 | 44.0 | ○ |
| Inventive example 11 | Batch-type equivalent | 65 | 1.8 | 230 | 48.0 | ○ |
| Inventive example 12 | Continuous-type equivalent | 21 | 0.8 | 290 | 44.0 | ○ |

The underline indicates that the underlined value fell out of the range defined in the present invention.

① Left-side calculation of the formula (2) or the formula (3) (° C.)

② Right-side calculation of the formula (2) or the formula (3) (° C.)

*Staying time period means "a staying time period at 400° C. to the lower limit temperature [Left-side calculation of the formula (2) or the formula (3)]".

The present examples 1 to 12 that satisfied all the requirements of the present example showed good values in both of 0.2% yield stress and elongation. In addition, all of them had average grain sizes of 15 μm or larger and included intermetallic compounds at 2% or less.

Meanwhile, Comparative example 1 was a pure titanium and low in 0.2% yield stress. Comparative examples 2 and 3 were low in elongation because they were treated at low annealing temperatures and thus fine. Comparative examples 4 and 5 were low in elongation because the content of Cu is high and thus crystal grains were fine, although the annealing temperatures satisfied the formulas (A) and (B). Comparative example 6 was low in elongation because the content of O is high. Comparative example 7 was low in elongation because Ni exceeded the upper limit value, the formula (B) was not satisfied, and thus crystal grains were fine.

Comparative example 8 was annealed at a temperature below the left side of the formula (B), and was lower in 0.2% yield stress and elongation than that of the present example 9 having the same composition and annealed at 750° C. Comparative example 9 was poor in balance between 0.2% yield stress and elongation because the time of retention at 400° C. to the lower limit temperature of the annealing was long, and thus the precipitation amount of intermetallic compounds was large. In addition, Comparative example 10 was low in elongation because of a high oxygen, and Ni was not added. In comparison with Example 9 for which Ni was added, while the crystal grain size was substantially the same, as for the time in the annealing performed at the same annealing temperature of 750° C., the present example 9 took 1 minute, whereas Comparative example 10 took 3 minutes. The presence/absence of Ni causes a difference between the taken times by three 3 times, and has a significant influence on productivity.

As for Comparative examples 11 and 12, Cu was not added. Therefore, only Ni resulted in insufficient 0.2% yield stresses, and failed to obtain an excellent balance between elongation and 0.2% yield stress.

The present example being excellent in balance elongation and 0.2% yield stress will be described with reference to FIG. 4. FIG. 4 is a graph in which the present examples, the comparative examples, and the results disclosed in Patent Document 3 and Patent Document 4 are plotted, where the horizontal axis represents 0.2% yield stress, and the vertical axis represents elongation. As illustrated in FIG. 4, all of the present examples satisfy an elongation of 42% or higher, 0.2% yield stress of 190 MPa or higher, and the formula (1).

The invention claimed is:

1. A titanium sheet having a chemical composition containing, in mass %:

Cu: 0.1 to 1.0%;

Ni: 0.10 to 0.20%;

Fe: 0.01 to 0.10%;

0: 0.01 to 0.10%;

Cr: 0 to 0.20%; and the balance: Ti and unavoidable impurities, and satisfying $0.04 \leq 0.3Cu+Ni \leq 0.44\%$, wherein an average grain size of a phase is 15 μm or larger, and an intermetallic compound of Cu and/or Ni, and Ti is at 2.0 volume % or less.

2. The titanium sheet according to claim 1, wherein an elongation [%] is 42% or higher, and a following formula (1) is satisfied:

$$(\text{Elongation})\ [\%] \geq -0.12 \times (0.2\%\ \text{yield stress})\ [\text{MPa}] + 73 \quad (1),$$

3. The titanium sheet according to claim 1, wherein the chemical composition contains, in mass %, Cr: 0.01 to 0.20%.

4. The titanium sheet according to claim 2, wherein the chemical composition contains, in mass %, Cr: 0.01 to 0.20%.

* * * * *